United States Patent [19]

Holzbaur et al.

[11] 4,263,235

[45] Apr. 21, 1981

[54] MIXTURE PREPARATION APPARATUS

[75] Inventors: Siegfried Holzbaur; Konrad Eckert, both of Stuttgart, Fed. Rep. of Germany

[73] Assignee: Robert Bosch GmbH, Stuttgart, Fed. Rep. of Germany

[21] Appl. No.: 14,200

[22] Filed: Feb. 22, 1979

[30] Foreign Application Priority Data

Feb. 22, 1978 [DE] Fed. Rep. of Germany ..... 2807465

[51] Int. Cl.[3] ..... F02M 17/16

[52] U.S. Cl. ..... 261/89; 261/44 D; 261/DIG. 74; 261/39 D

[58] Field of Search ..... 261/89, 90, 88, 44 D

[56] References Cited

U.S. PATENT DOCUMENTS

| | | | |
|---|---|---|---|
| 1,947,162 | 2/1934 | Mock | 261/44 D |
| 2,197,647 | 4/1940 | Lorenzen | 261/88 |
| 2,314,170 | 3/1943 | Snyder | 261/89 |
| 2,397,327 | 3/1946 | Pratt | 261/90 |
| 2,932,495 | 4/1960 | Olson | 261/89 |
| 2,941,872 | 6/1960 | Pilo et al. | 261/89 |
| 3,439,903 | 4/1969 | Tolnai | 261/89 |
| 3,591,148 | 7/1971 | Schmitz | 261/44 D |
| 4,021,512 | 5/1977 | Kaufman | 261/89 |
| 4,044,081 | 8/1977 | Weidlich | 261/89 |
| 4,161,935 | 7/1979 | Eckert et al. | 261/44 D |
| 4,170,975 | 10/1979 | Wessel et al. | 261/88 |

FOREIGN PATENT DOCUMENTS

| | | | |
|---|---|---|---|
| 97821 | 4/1924 | Austria | 261/89 |
| 2407995 | 2/1975 | Fed. Rep. of Germany . | |
| 2527633 | 1/1976 | Fed. Rep. of Germany . | |
| 2536996 | 2/1977 | Fed. Rep. of Germany . | |
| 2654988 | 6/1977 | Fed. Rep. of Germany | 261/DIG. 78 |
| 2300226 | 9/1976 | France . | |
| 208141 | 11/1923 | United Kingdom | 261/88 |
| 1472015 | 4/1977 | United Kingdom . | |

*Primary Examiner*—Tim R. Miles

*Attorney, Agent, or Firm*—Edwin E. Greigg

[57] ABSTRACT

A mixture preparation apparatus for mixture-compressing, externally ignited internal combustion engines, which serves to improve the output and to reduce both fuel consumption and the proportion of toxic components in the exhaust gas of the internal combustion engine. The mixture preparation apparatus comprises a rotatable vane body having vanes, or scoop members, disposed in the air intake line across the air flow direction, and including a portion arranged to extend into a section of the air intake line. The rotatable scoops are disposed in the region of an annular flow channel, so that between the inflow and the outflow side of the flow channel a constant, yet arbitrarily variable pressure difference can be regulated. The structure revealed requires only a small air component to drive the vane body, and thus only a limited energy requirement is present. The axial displacement motion of the vane body or of a cover body connected to the vane body represents a standard for the induced air quantity and can serve to control a fuel apportionment apparatus.

14 Claims, 5 Drawing Figures

55
88
90
86
87
63
18
81
82
20
17
83
40
14
19
80
65
13
84
66
71
89
1
16
8
68
2
70
3
85
95
69
-4-
77
27
92
72
5
94
28
76
93
7
61
55
75
78
73
91
74

MIXTURE PREPARATION APPARATUS

BACKGROUND OF THE INVENTION

The invention relates to a mixture preparation apparatus having a throttle device and a vane body in the air intake line provided with a rotatable scoop, with the scoop arranged to extend into a widened section of the air intake line during increased air flow. A mixture preparation apparatus is already known in which flow rates which are sufficient to cause a rotation of a vane body disposed across the flow direction in the air intake line, with the fuel delivery into the air intake line taking place upstream of the vane body, first arise when the air throughputs are high. The rotary speed of the vane body and thus the resultant loss increase as the air throughputs increase.

OBJECT AND SUMMARY OF THE INVENTION

The fuel preparation apparatus of the present invention has the advantage over the prior art that even at the smallest air throughputs sufficient flow speeds arise which cause a rotation of the vane body, by which means the delivered fuel is accelerated toward the circumference of the vane body and thus undergoes a shearing force, so that as a result of the fine fuel film which exits therefrom an intensive mixing with the induced air quantity is accomplished, thus, at a virtually constant return force the energy consumption from the air flow remains virtually constant.

A further advantage is the small structural size and the cost-effective production of the mixture preparation apparatus according to the invention.

By means of the characteristics disclosed in the dependent claims, advantageous further embodiments and improvements of the mixture preparation apparatus disclosed in the claim 1 are also possible.

The control of a fuel apportionment apparatus by means of the axial displacement motion of the vane body or of a cover body connected to the vane body, which represents a standard for the induced air quantity, is particularly advantageous.

It is also a further advantage to include a safety ring that is associated with the air intake line so that during backfiring in the intake manifold of the internal combustion engine the safety ring is displaced by the vane body or by a cover body arranged to cooperate with the vane body with the arrangement being such that the safety ring moves into a position in which it opens at least one relief aperture of the intake tube upstream of the vane body or of the cover body toward the atmosphere.

The invention will be better understood as well as further objects and advantages thereof become more apparent from the ensuing detailed description of preferred embodiments taken in conjunction with the drawings.

DESCRIPTION OF THE PREFERRED EMBODIMENTS

Figure 1:
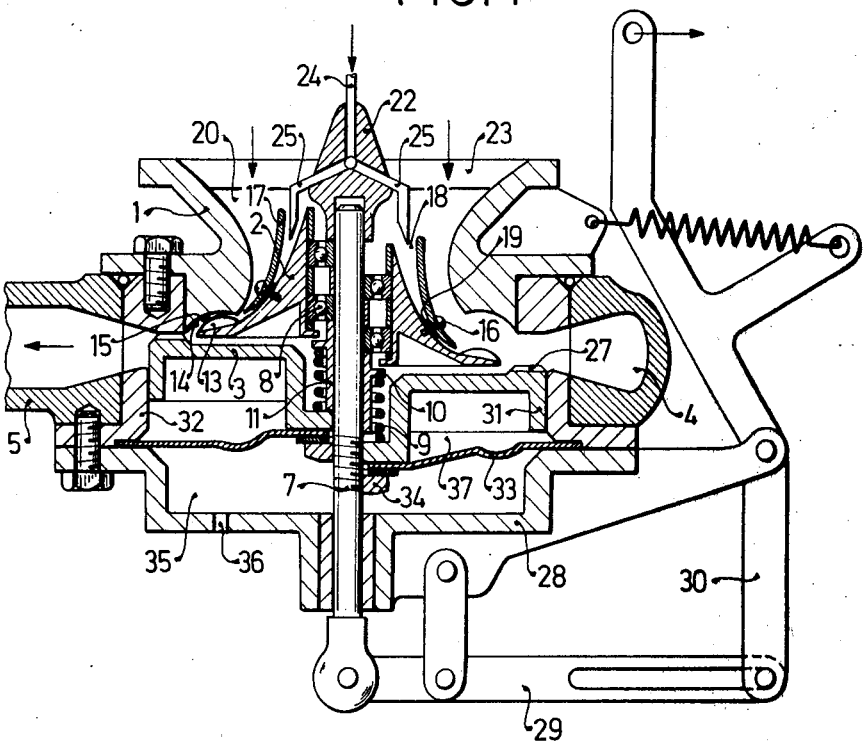
FIG. 1 shows generally in a cross-sectional view a first embodiment of a mixture preparation apparatus.

In the mixture preparation apparatus shown in FIG. 1, combustion air flows in the direction of the arrows through an air filter (not shown) via a conical section 1 of an air intake line, within which a vane body 2 is disposed and with the conical section 1 being arranged to be blocked downstream by a throttle device 3. As shown in this view, intake air then flows into an annular channel 4, which is in communication through one or more branches 5 with the individual cylinders of a mixture-compressing, externally ignited internal combustion engine. The vane body 2 is disposed across the air flow direction and is embodied in a manner favorable to the flow, preferably approximately conical in shape. The support of the vane body 2 is preferably provided on an actuation rod 7 of the throttle device 3 which is supported coaxially with the conical section 1. In order to support the vane body 2 on the actuation rod 7 there are preferably roller bearings 8, whose outer bearing race or ring is rigidly connected with the vane body 2 and whose inner bearing race or ring can glide vertically on the actuation rod 7, so that a rotation of the vane body 2 is attained which is as free of friction as possible. The axial displacement of the vane body 2 takes place against the force of a return spring 9, with said spring being supported at one end on an annular collar 10 of a sleeve 11 which contacts the roller bearing 8 and at the other end abuts against the throttle device 3. Instead of being supported on the throttle device, the return spring 9 could equally well be supported on a stop that is attached to the housing, which is not shown. The return force exerted on the vane body 2 could also be generated by pressure fluid, as is shown in the embodiments according to FIGS. 4 and 5.

The vane body 2 is provided with vanes or scoop members 13, which are disposed in the region of an annular flow channel 14 with said channel being formed on one side by a contoured section 15 of the conical section 1 of the air intake line which is complemental to the shape of the scoop member 13 and on the other side by the vane body 2. As a result of the virtually constant return force exerted by the return spring against the vane body 2, the axial displacement of said vane body takes place in accordance with the induced air quantity in such a manner that at the vane body 2 and thus also between the inlet and the discharge sides of the flow channel 14 a virtually constant flow speed prevails over the entire adjustment range and as a consequence the vane body 2 rotates at a virtually constant rotary speed, and therefore the energy consumption from the flow remains virtually constant.

A current or flow-shaping guide element 17 is arranged to partially grasp the vane body 2 in the manner of a casing and is connected by fastening elements 16 with the vane body 2 in such a manner that between the vane body 2 and the guide element 17 a partial flow guidance channel 18 is formed. In the area of the fastening elements 16 there are spacer elements 19 provided between the vane body and the guide element, by means of which a certain predetermined distance between the vane body and guide element is maintained. Between the guide element 17 and the air intake line wall in the region of the conical section 1, a main flow guidance channel 20 is formed. The partial flow guidance channel 18 is opened upstream toward the air intake line and discharges downstream into the inlet side of the flow channel 14 provided in the region of the scoop member 13. Upstream of the vane body 2 there is a fuel distributor body 22 which is affixed via strip elements 23 to the conical section 1 of the air intake line. Apportioned fuel is delivered through a line 24 to the fuel distributor body 22, whereby the fuel apportionment may be accomplished, for example, in accordance with the embodiments shown in FIGS. 3–5. Small fuel lines or conduits 25 communicate within the fuel distributor body 22 with the line 24 and thus discharge fuel into the partial flow guidance channel 18. Within the partial flow guidance channel 18, a pre-preparation of the apportioned fuel with the partial air quantity which also flows through the partial flow guidance channel 18 is effected, while the mixture is being transported to the inlet side of the flow channel 14. By means of the rotation of the vane body 2, the delivered fuel is very greatly accelerated toward the circumference of the vane body and thus is subjected to a shearing motion; thus in this manner fuel is caused to spin off from the circumference of the vane body 2 as a very fine film and can intimately mix with the induced air quantity. This intimately prepared fuel-air mixture leads to a reduction of the fuel consumption and simultaneously to an improvement in the power output of the engine and a limitation of the toxic exhaust gas components.

The drawing in FIG. 1 shows two different operations, i.e., viewing the drawing to the left of the actuation rod 7 shows the position of the vane body 2 and the throttle device 3 during engine idling and that to the right of the rod 7 represents the full-load position. During idling operation of the engine, virtually the entire induced air quantity flows over the partial flow guidance channel 18 to the inlet side of the flow channel 14, while at full-load the portion of the induced air quantity flowing over the partial flow guidance channel 18 is limited in comparison with the portion of the induced air quantity flowing over the main flow guide channel 20.

The throttle device 3 connected with the actuation rod 7 is embodied in the form of a disc and in its idling position rests with its upper front face 26 oriented toward the flow and in abutment with the wall of the conical section 1. The front face 26 of the throttle device 3 is provided with grooves 27 (FIG. 2) which extend radially, for example, and over which the idling mixture quantity can flow past the throttle device. Simultaneously, these grooves serve the purpose of converting the swirling intimate mixture which is generated by the vane body 2 to a calm radial flow as it enters the channel 4. A lever system comprising rods 29 and 30 are arranged to contact the perpendicularly disposed actuation rod 7 supported within a housing cap 28 and is connected to an arbitrarily actuatable gas pedal, not shown. When the throttle device 3 performs an opening movement in the direction of flow, the pressure drop at the vane body 2 changes in such a manner that the vane body 2 is likewise moved in the flow direction in the manner of a baffle disc operating on the principle of pressure equalization, until the pressure drop determined by the return spring 9 again prevails at the vane body 2. The axial position of the vane body 2 is thus a standard for the induced air quantity. The throttle device 3 may be provided with a collar 31 and by means of which it is axially guided by a wall 32 that is arranged in the air intake line. A diaphragm 33 is provided on the one hand for sealing purposes and on the other hand to compensate for the air forces contacting the throttle device 3. The diaphragm is affixed at its circumference between the housing cap 28 and the guide wall 32 and in the center it is secured to the throttle device 3 by means of a nut 34. The chamber 35 formed between the diaphragm 33 and the housing cap 28 communicates with the atmosphere via an aperture 36. A chamber 37 is arranged on the other side of the diaphragm and the intake tube pressure downstream of the throttle device prevails at this point. The described embodiment of the invention provides a relatively small structural device and in addition such a device is economical to manufacture.

Figure 2:
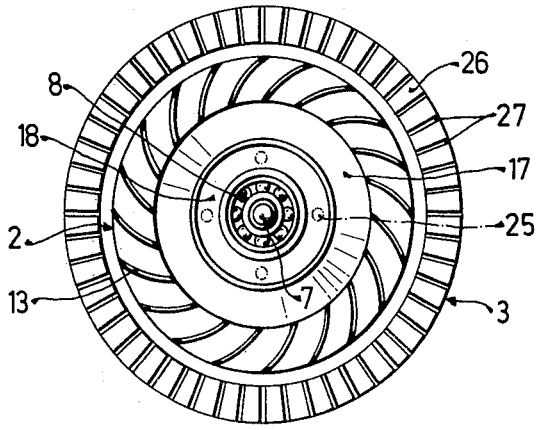
FIG. 2 is a top plan view of the mixture preparation apparatus in accordance with FIG. 1.

In FIG. 2 there is shown a top plan view of the mixture preparation apparatus as shown in cross section in FIG. 1, in which the conical section 1, the annular channel 4, the branch 5 and the fuel distributor body 22 are not shown.

Figure 3:
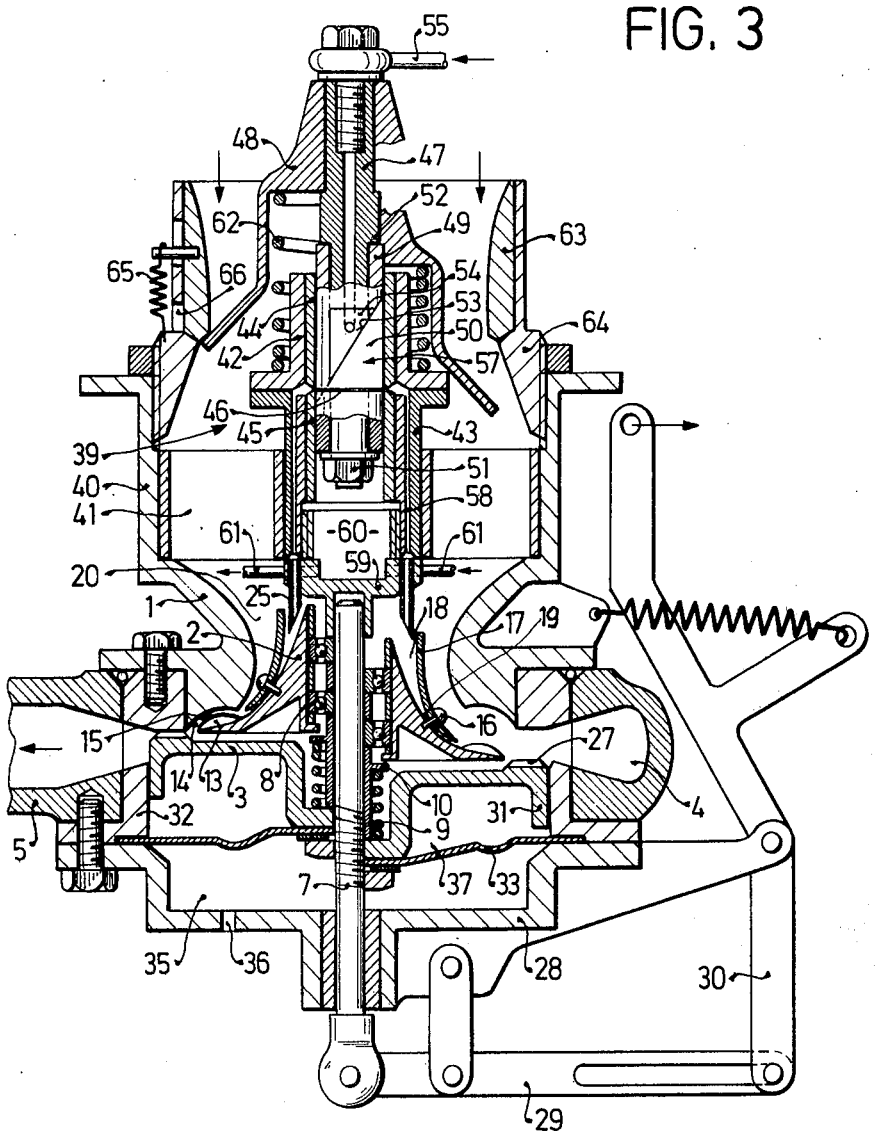
FIG. 3 shows generally in a cross-sectional view a second embodiment of a mixture preparation apparatus.

In the second embodiment of a mixture preparation apparatus according to FIG. 3, the apparatus described earlier herein is supplemented by incorporating therewith a fuel apportionment apparatus 39. The elements in FIG. 3 which remain the same as those in the embodiment of FIG. 1 are indicated by the same reference numerals.

The fuel apportionment apparatus 39 is preferably supported by means of transversely disposed elements 41 within a section 40 of the air intake body upstream of the conical section 1. There are bearing sleeves 44 and 45 that are vertically disposed within the abutting carrier sleeves 42 and 43 with which they are connected. It is also to be noted that these sleeves provide a control slit 46 between their front faces which are oriented toward each other, as shown in the drawing. A barrier device 48 which closes the air intake line section 40 in the outlet position is disposed coaxially relative to the vane body 2 within the air intake line section 40 by means of a guide rod 47. The guide rod 47 is slidably supported via bearing casings 49, 50 in the bearing sleeves 44, 45. The bearing casings 49, 50 are pressed by a threaded element such as a nut 51 against a stop 52 of the guide rod 47 and are preferably composed of two partial casings with a diagonally disposed separation seam 53. Proceeding from the diagonal separation seam 53, a triangular control aperture 54 is preferably machined into the bearing casing 49. A fuel supply line 55 which extends partially within the guide rod 7 discharges into the control aperture 54 and communicates with a fuel pump (not shown). The control slit 46 and the control aperture 54 comprise a fuel apportionment valve 57, and in this manner more or less fuel is apportioned corresponding to the extent to which the control slit 46 and the control aperture 54 are covered. Naturally there is a correlation with these elements and the position of the barrier device 48 and thus the induced air quantity. The fuel apportioned at the fuel apportionment valve 57 proceeds via channels 58 into the fuel conduits 25, which discharge into the partial flow guide channel 18. The end of the carrier sleeve 43 which is adapted to point downstream is closed by means of a cap 59 which is connected with said carrier sleeve. In this way a pressure chamber 60 is defined in the interior of the carrier sleeve 43 and into this chamber the guide rod 47 is arranged to project, as is clearly shown in FIG. 3. The pressure chamber 60 may be attached to a control pressure line 61, which supplies it with fluid under pressure. The pressure fluid within the pressure chamber 60 generates the return force acting on the barrier device 48 which functions as the air flow rate meter. Accordingly, in this manner the pressure of the pressure fluid can be preferably held constant or can be varied in accordance with engine operating characteristics in order to vary the fuel-air mixture and to adapt to operational requirements. A return spring 62 supported on one end on the carrier sleeve 42 and on the other end at the barrier device 48 and having the flattest possible characteristic serves to hold the barrier device 48 in its position shown in the left one-half of the view of FIG. 3 when the engine is stopping. The barrier device 48 in its position as shown in the left one-half view of FIG. 3 is thus arranged to block the air intake line section 40. At this time the barrier device abuts against a safety ring 63 which is supported within the section 40 and when it makes its downward opening movement (right-hand view of FIG. 3) it then extends into a conically widening section 64 of the section 40. Should backfiring happen during engine operation, the safety ring 63 is displaced in an upward direction by the barrier device 48 against the force of a spring 65. In this way the safety ring 63 is moved counter to the normal air flow direction, by which means at least one relief aperture 66 of the air intake line section downstream of the barrier device 48 opens toward the atmosphere, so that damage to the apparatus is avoided. The air flow direction in each case is shown by means of arrows. The view of the intake in FIG. 3 is similar to that of FIG. 1, i.e., the right-hand portion of the drawing shows the vane body 2, throttle device 3 and barrier device 48 in the full-load position.

Figure 4:
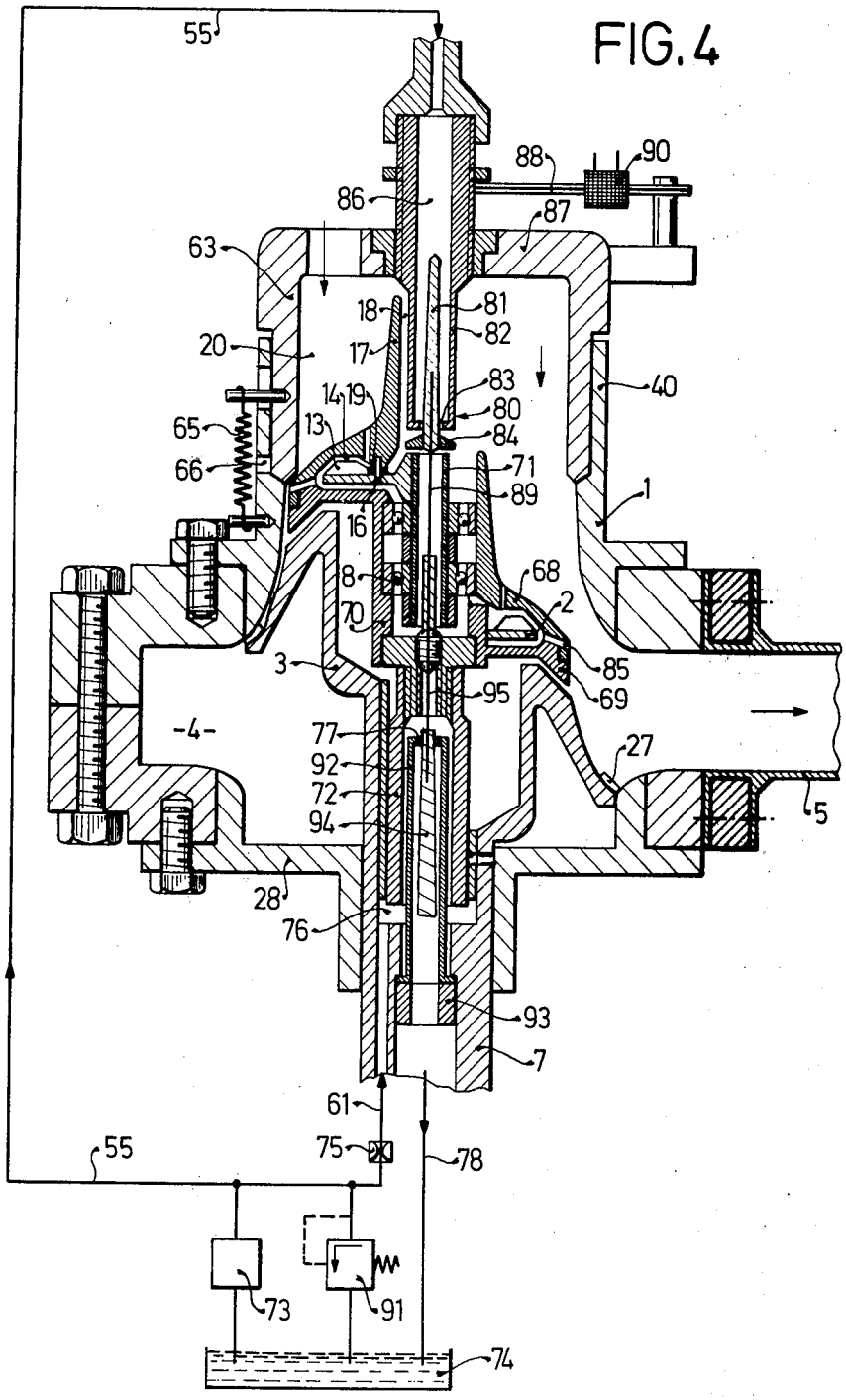
FIG. 4 shows generally in a cross-sectional view a third embodiment of a mixture preparation apparatus.

In the third embodiment of this invention according to FIG. 4, the elements which are the same as in the foregoing embodiments are identified by the same reference numerals. Also in this view as in the earlier embodiments, the left one-half of the drawing shows the air intake closed and the right one-half shows the throttle fully open.

In contrast to the foregoing embodiments, there is a cover body 68 provided in this embodiment, which in a manner favorable to air flow projects over the scoop 13 and forms together with the vane body 2 the annularly embodied flow channel 14 in the region of the scoop. The main flow guide channel 20 is thus formed in this embodiment between the air intake wall on one side and the guide element 17 and the cover body 68 on the other side. The cover body 68 is connected to a carrier body 69, which has a bearing portion 70 within which the vane body 2 connected with a bearing sleeve 71 is rotatably supported via the roller bearings 8. The cover body 68 and the vane body 2 are rigidly connected in an axial direction and arranged to move in unison. The bearing portion 70 of the carrier body 69 is connected with a glide sleeve 72, which is axially displaceably supported, preferably coaxially with the throttle device 3 and positioned within the actuation rod 7 of the throttle device 3. The cover body 68 likewise serves as an air flow rate meter which operates on the principle of pressure equalization, the axial position of which represents a standard for the induced air quantity. Preferably pressure fluid serves as the return force of the cover body 68 which acts as the air flow rate meter. To this end, a control pressure line 61 branches off from a fuel supply line 55, into which fuel is supplied by a fuel pump 73 from a fuel container 74, and leads via a decoupling throttle 75 to a pressure chamber 76 which is provided within the actuation rod 7 of the throttle device 3. The glide sleeve 72 has a terminal end that is remote from the cover body 68 and this is adapted to project into the pressure chamber 76. The pressure chamber 76 also communicates via a further throttle point 77 with a return flow line 78 that extends to the fuel container 74. In accordance with the fuel pressure controlled within the pressure chamber 76, a return force is exerted by the glide sleeve 72 on the cover body 68, and this counteracts the air force which acts in the opening direction of the cover body.

Since the axial position of the cover body 68 corresponds to the induced air quantity, the displacement movement of the cover body can be utilized to control a fuel apportionment valve 80. To this end, the movable valve member of the fuel apportionment valve 80, embodied in the form of a valve needle 81, is connected, for example, with the bearing portion 70 of the cover body 68. The movable valve part 81 projects upstream of the vane body 2 into a nozzle aperture 83 that is provided within a nozzle element 82. Thus, by means of the valve needle 81, a quantity of fuel is apportioned at the nozzle aperture 83 which is proportional to the position of the cover body 68 and thus to the air quantity. The fuel apportioned at the nozzle aperture 83 flows over a guide body 84 connected with the valve needle 81 into the partial flow guide channel 18, within which, pre-prepared with air, it is further conveyed through the channel 18 toward the flow channel 14 in the region of the scoop 13. Radial guide apertures 85 are provided in the cover body 68, which serve to reduce the spin of the flow which emerges from the flow channel 14.

Fuel is delivered to the nozzle aperture 83 of the fuel apportionment valve 80 via a bore 86 within the nozzle element 82, which bore 86 communicates with the fuel supply line 55. The nozzle element 82 may be supported axially displaceably on a means 87 which is connected to the safety ring 63. In order to obtain an enrichment of the fuel-air mixture during cold starting and during the warm-up phase of the internal combustion engine, the nozzle element 82 and thus the nozzle aperture 83 can be axially displaced by means of an element operating in accordance with temperature, for example a bimetallic spring 88, so that the apportionment cross section and thus the apportioned quantity of fuel at the fuel apportionment valve 80 are increased. In order to provide control of the enrichment in accordance with time and temperature, an electrical heating element 90 may be disposed on the bimetallic spring 88 and it is contemplated that the electric circuit of this element 90 is closed when ignition pulses for the internal combustion engine are present. The valve needle 81 may advantageously be flexibly-elastically connected via a guide wire 89 with the bearing portion 70 of the cover body 68, as shown in FIG. 4. The flexible-elastic fixation of the valve needle 81 relative to the guide wire 89 permits greater tolerances in the centering between the valve needle 81 and nozzle opening 83, without the valve needle 81 being tilted within the nozzle aperture 83. The cover body 68 rests during engine idling on the safety ring 63, whose function was already described above in connection with the foregoing embodiment.

Since, when the internal combustion engine is not running, the control pressure in the control pressure line 61 and thus in the pressure chamber 76 as well is lowered, the cover body 68 in the illustrated arrangement of the mixture preparation apparatus moves downward along with the vane body 2, so that the conically embodied valve needle 81 of the fuel apportionment valve 80 opens an apportionment cross section at the nozzle aperture 83 which is as large as possible. Accordingly, when the engine is started, a large fuel quantity is briefly apportioned in the desired manner at the widely opened fuel apportionment valve 80, by which means the fuel-air mixture is enriched. The control pressure that builds up in the pressure chamber 76 immediately after the engine is started then also builds up the required return force at the cover body 68 again, by which means the valve needle 81 is displaced into a position in which a fuel quantity which corresponds to the induced air quantity is apportioned at the fuel apportionment valve 80.

The pressure in the fuel supply line 55 can be regulated by means of a pressure limting valve 91. In order to adapt the fuel-air ratio to various operational requirements, a pressure control valve may be disposed within the control pressure line 61, by means of which valve the control pressure and thus the return force exerted on the cover body can be varied. Thus, for example, the throttle point 77 may be variably embodied. To this end, the throttle point 77 may be provided within a valve member 92, which is disposed within the interior of the actuation rod 7 and connected therewith by an annular ring 93. A valve needle 94 is adapted to project through the throttle point 77 into the interior of the valve member 92. The valve needle 94 is guided flexibly-elastically by a guide wire 95 which is connected with the bearing portion 70 of the cover body 68. Also, the valve needle is embodied conically in such a manner that the cross section of the valve needle 94 which projects downstream of the throttle point 77 is enlarged, as is clear from the drawing. The described variable throttle point 77 serves to compensate for the relatively large middle-range error predominant at low engine speeds and to compensate for the air density error produced when the geodetic height varies, for without this compensation an overly rich fuel-air mixture would be apportioned. The compensation for an undesired mixture enrichment during operation of the engine at greater geodetic heights, i.e., higher altitudes, in comparison with operation at sea level is accomplished as follows. During the transition from operation of the engine at sea level to that at a higher altitude and with the resultant decrease in air density at such increased heights, the quantity of air induced by the engine is simultaneously reduced so that when the throttle device 3 is held in the same opening position and when there is the same return force, the cover body 68 closes the conical section 1 to a further extent than during operation at sea level. Thus, as a result of the direct coupling between the valve needle 81 and the cover body 68, a smaller fuel quantity is simultaneously apportioned at the fuel apportionment valve 80. However, as a result of the non-linear relationship, this correction of the fuel-air ratio by means of the automatic displacement of the cover body 68 acting as a barrier body causes a compensation of the air density error only by approximately one-half; so even then, an overly rich fuel-air ratio is controlled. The full compensation of the air density error and thus the controlling of the fuel-air ratio to approximately $\lambda=1$ now takes place in accordance with the invention by means of the variable embodiment of the throttle point 77. By appropriately adapting the contour of the valve needle 94, the flowthrough cross section of the throttle point 77 within the control pressure line 61 becomes smaller during operation at higher altitudes as a result of the described displacement of the cover body 68 and thus the return flow quantity over the return flow line 78 is reduced, so that the control pressure within the pressure chamber 76 and thus the return force exerted on the cover body 68 are increased and the cover body 68 is displaced still further in the closing direction in order to obtain full compensation of the air density error. This further displacement of the cover body 68 in the closing direction causes a further reduction of the fuel quantity apportioned at the fuel apportionment valve 80 and thus directs the fuel-air ratio to approximately $\lambda=1$, thus providing full compensation for the air density error.

The described embodiment additionally causes a compensation for the middle-range error caused by pulsation in the air intake line, which error results in an overly rich fuel-air mixture. This error is increased particularly at engine speeds of approximately 1000 to 2000 rpm and at the full-load position of the throttle device 3. Under these operating conditions, the cover body 68 is displaced only to a limited extent in the opening direction because of the limited quantity of induced air, so that the valve needle 94 with its appropriately adapted contour at the throttle point 77 opens up only a small flowthrough cross section at the throttle point 77 and the control pressure in the pressure chamber 76 and thus the return force exerted on the cover body 68 are increased. By this means the cover body 68 is displaced further into the closing position until there is a balance between the force of air exerted on the cover body 68 and the return force, and thus the fuel quantity apportioned at the fuel apportionment valve 80 is reduced. Thus in accordance with the contour of the valve needle 94, a fuel-air ratio of approximately $\lambda=1$ can be controlled.

In the embodiment illustrated in FIG. 4, a desired enrichment of the fuel-air mixture for acceleration is achieved as a result of the following course of events. The cover body 68 is first moved in the opening direction when there is a sudden opening movement of the throttle device 3, as a result of the incompressibility of the pressure fluid in the pressure chamber 76; thus the fuel apportionment valve 80 immediately opens, and only thereafter is there a pressure equalization in the pressure chamber 76 via throttle points 75, 77 and a refilling of the pressure chamber 76 with fuel, so that the cover body 68 and therewith the fuel apportionment valve 80 are again displaced further in the closing direction. During a sudden closing movement of the throttle device 3, the cover body is likewise moved in the closing direction as a result of the incompressibility of the fuel in the pressure chamber 76 and thus the fuel-air mixture is leaned in the desired manner until a pressure equalization occurs in the pressure chamber 76.

Figure 5:
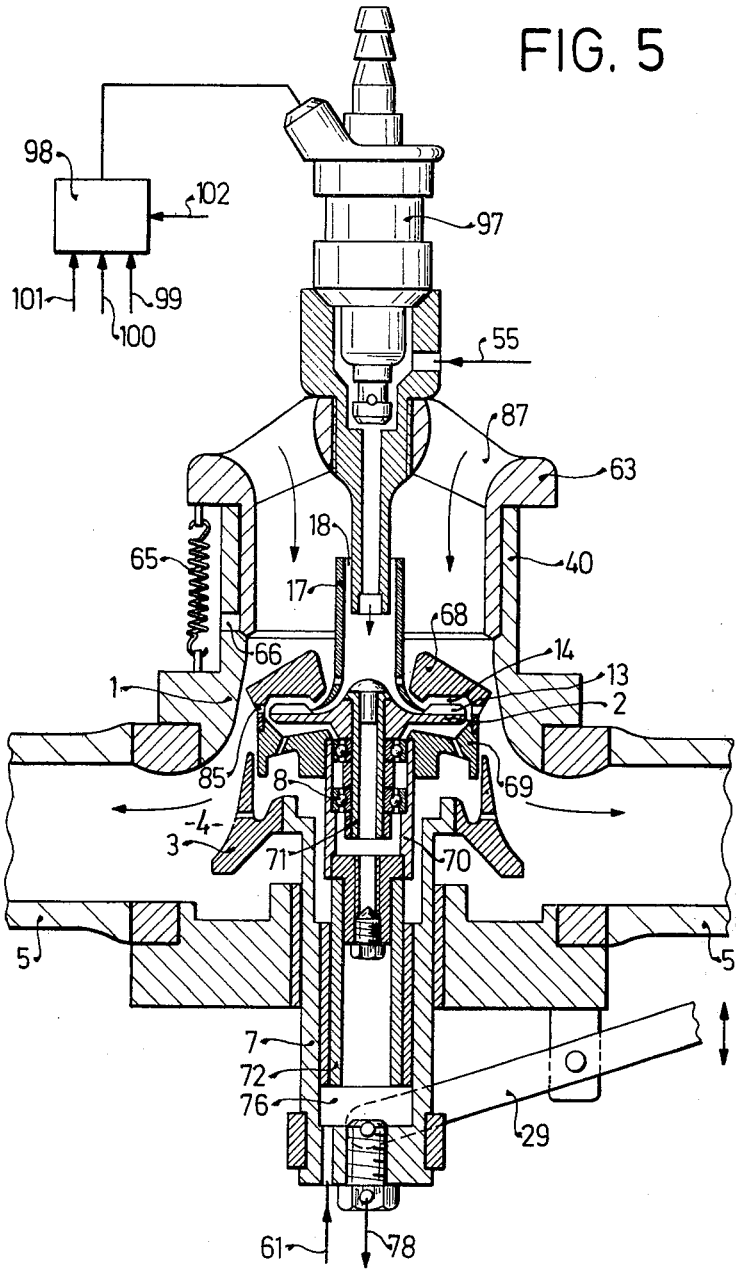
FIG. 5 shows a cross-sectional view of a fourth embodiment of a mixture preparation apparatus with an electromagnetically operated valve shown in elevation.

The fourth embodiment according to FIG. 5 differs from the previous embodiments essentially in that the fuel apportionment takes place via an electromagnetic valve 97, which is driven by an electronic control device 98 into which operational characteristics such as, for example, induced air quantity 99, temperature 100, rpm 101 or a value 102 characterizing the exhaust gas composition are fed, having been converted into electrical signals. The induced air quantity could, for example, be ascertained by a heating-wire air flow rate meter, not shown, or the axial position of the cover body 68 could be fed in electrical signals in a known manner to the electronic control device 98 by a pick-up or other suitable detector means. The electromagnetic valve 97 is advantageously disposed via strips 87, coaxially with the cover body 68, on the safety ring 63 upstream. The electromagnetic valve 97 injects the apportioned fuel into the partial flow guide channel 18 within which the pre-preparation with air and the further conveyance into the flow channel 14 takes place in the manner already described above.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A mixture preparation apparatus for mixture-compressing, externally ignited internal combustion engines having a throttle device and a rotatable vane body in the air intake line provided with a plurality of scoops, said scoops arranged to extend into a contoured section of the intake side of an annular flow channel and spaced therefrom in an axial direction during increased air quantities and means upstream of the vane body for introducing fuel into said air intake line, further wherein said scoops are configured to cooperate with said annular flow channel and means for arbitrarily controlling air-fuel mixture to said annular flow channel and therefrom to said engine.

2. A mixture preparation apparatus in accordance with claim 1, further including means for delivering fuel to the inflow side of the flow channel.

3. A mixture preparation apparatus in accordance with claim 1, further wherein said widened section of said air intake line discharges into an annular channel from which at least one branch line is arranged to lead to the individual cylinders.

4. A mixture preparation apparatus in accordance with claim 1, further wherein said vane regulates a pressure difference-between the inflow side and the outflow side of the flow channel and is determinable by a return force which cooperates with said vane body.

5. A mixture preparation apparatus in accordance with claim 4, further wherein said flow channel is formed on one side by a section of said air intake line having the curvature of said rotatable scoops and on the other side by said vane body.

6. A mixture preparation apparatus in accordance with claim 1, further wherein a flow-shaping guide element is connected with said vane body to provide first a partial flow guidance channel between said vane body and a guide element and second a main flow guidance channel between said guide element and said air intake line.

7. A mixture preparation apparatus in accordance with claim 6, further wherein said partial flow guidance channel is opened upstream toward said air intake line and is further arranged to discharge into the inflow side of the flow channel provided in the region of said scoops on said rotatable vane body.

8. A mixture preparation apparatus in accordance with claim 7, further including means for delivering said fuel into said partial flow guidance channel.

9. A mixture preparation apparatus in accordance with claim 1, further wherein said throttle device is guided by an actuation rod supported coaxially relative to said air intake line.

10. A mixture preparation apparatus in accordance with claim 9, further wherein said throttle device has a circumference which is provided with grooves, across which a flow past said throttle device can take place when said throttle device closes said air intake line during engine idling.

11. A mixture preparation apparatus in accordance with claim 9, characterized in that a diaphragm is connected to the throttle device, said diaphragm being subjected on one side to said intake tube pressure downstream of said throttle device and on the other side to atmospheric pressure, and further that a resultant force on said diaphragm acts counter to the force contacting the throttle device as a result of drop in pressure.

12. A mixture preparation apparatus in accordance with claim 9, further wherein said vane body is rotatably and slidably supported coaxially relative to said throttle device.

13. A mixture preparation apparatus in accordance with claim 12, further wherein a spring means is interposed between said vane body and said throttle device, said spring means arranged to apply a return force on said vane body.

14. A mixture preparation apparatus in accordance with claim 12, characterized in that a spring, which is disposed with one end fixed to the housing and with the other end contacting vane body, acts as the return force of the vane body.

* * * * *